United States Patent [19]

Northcraft

[11] 4,373,508

[45] Feb. 15, 1983

[54] ADJUSTABLE MEANS FOR SUPPORTING COMBUSTIBLE MATERIAL

[76] Inventor: Richard D. Northcraft, Rte. 3, Box 450, Escondido, Calif. 92025

[21] Appl. No.: 275,371

[22] Filed: Jun. 19, 1981

Related U.S. Application Data

[62] Division of Ser. No. 84,621, Oct. 12, 1979, abandoned.

[51] Int. Cl.[3] ..... F23H 13/00

[52] U.S. Cl. ..... 126/298; 126/164; 248/246

[58] Field of Search ..... 126/25 A, 30, 298, 164, 126/152 B, 165, 137; 248/246, 295 B; 211/60 R; 99/421 HV, 421 R; D7/207, 211; D23/96

[56] References Cited

U.S. PATENT DOCUMENTS

| | | | |
|---|---|---|---|
| 1,129,553 | 2/1915 | Cope | 248/68 R |
| 2,600,753 | 6/1952 | Gilbert | 126/298 |
| 3,205,772 | 9/1965 | Guske | 248/246 |
| 4,069,808 | 1/1978 | Cranberg | 126/164 |
| 4,083,354 | 4/1978 | Claire | 126/30 |

FOREIGN PATENT DOCUMENTS

| | | | |
|---|---|---|---|
| 217177 | 2/1961 | Austria | 248/246 |
| 1264653 | 5/1961 | France | 248/246 |
| 2371173 | 7/1978 | France | 126/30 |

*Primary Examiner*—James C. Yeung

*Attorney, Agent, or Firm*—Bruno J. Verbeck; Michael L. Slonecker

[57] ABSTRACT

Disclosed herein is an improved means particularly adapted for supporting combustible material in a preferred geometrical relationship during the combustion thereof, said means being especially suited for burning logs, tightly rolled newspapers, or the like, characterized by few, if any, surface texture irregularities. Said geometrical relationship generally comprises disposing a first coplanar tier of combustible material over a substantially identical second tier of combustible material in substantially parallel relationship therewith and spaced apart from each other at a preselected vertical distance. Said means comprises a plurality of spaced pairs of log supporting members aligned relative to each other such that said tiers of combustible material may be supported thereupon in stacked fashion and spaced apart said preselected distance. At least one pair of said log supporting members are adjustably supported upon a spaced pair of vertical members, said log supporting members having spaced abuttment members projecting therefrom towards and frictionally engaging opposite side portions of said vertical members. Shoulder means are formed on one of said abuttment members to prevent relative separating movement between said vertical and log supporting members except when said log supporting members are moved in an upward swinging movement about one of said abuttment members.

8 Claims, 3 Drawing Figures

ADJUSTABLE MEANS FOR SUPPORTING COMBUSTIBLE MATERIAL

CROSS-REFERENCE TO RELATED APPLICATIONS

This application is a division of U.S. Ser. No. 084,621, filed Oct. 12, 1979, abandoned.

BACKGROUND OF THE INVENTION

The present invention relates to a combustible material support device, and more particularly to an adjustable device for supporting logs, rolled newspapers, or the like, during burning within a fireplace enclosure.

In this particular art, it is common to provide a log-supporting grate elevated above the floor of a fireplace in order to permit adequate air circulation during combustion. A multiplicity of logs are stacked thereon, each of the logs being arranged substantially parallel to one another and in general contact along their longitudinal dimension. Due to the substantial surface texture irregularities inherent in the combustible materials used, such irregularities generally provide adequate displacement between the logs whereby to permit air circulation during combustion. However, as the irregularities are decreased, as is the case when tightly rolled newspapers or the like are used, and the logs are more substantially urged against one another, their points of contact serve to restrict or inhibit the flow of air necessary to ensure efficient and complete combustion.

By way of example to identify the present state of the art within this field, the following cited patents are of interest: Mitchell, U.S. Pat. No. 1,070,162; Wellman, U.S. Pat. No. 2,585,523; Gilbert, U.S. Pat. No. 2,600,753; Eller, U.S. Pat. No. 4,029,078; Cranberg, U.S. Pat. No. 4,069,808; and Mayes, U.S. Pat. No. 4,136,677.

Because of the current interest in alternate sources of energy to reduce dependence on fossil fuels, it has been suggested that various paper products, currently being disposed of, could be beneficially used in roll-log form and burned in a fireplace. However, the conspicious absence of surface texture irregularities upon such logs results in inadequate air circulation when they are used upon conventional devices such as those heretobefore identified, generally causing such logs to smolder and burn inefficiently.

A still further drawback associated with the prior art devices resides in the fact that once burning commences it is difficult, if not impossible, to replace consumed logs in a manner which maintains enhanced air circulation.

Therefore, it is an object of the present invention to provide a device which permits the complete and efficient burning of combustible material characterized by substantially few, if any, surface texture irregularities.

Still further, it is an object of the present invention to provide a device which permits the adjustment of log position and replenishment thereof during combustion while concurrently maintaining said logs in a preferred geometrical relationship enhancing air circulation.

It is yet another object to provide a device able to accomodate multiple tiers of logs having variable longitudinal and cross-sectional dimensions in said preferred geometrical relationship.

A still further object is to provide a device able to maintain a preferred ratio between combustible material, airflow, and ignition temperature whereby to produce a long-lasting fire.

SUMMARY OF THE INVENTION

The present invention is directed to means for supporting combustible material in a preferred geometrical relationship whereby to enhance air circulation thereabout during combustion.

Briefly stated, said means comprises a plurality of log support or lateral members adjustably secured for vertical movement upon a supporting frame, said supporting frame comprising a base portion disposed upon ground and at least two vertical members secured to said base portion and projecting upwardly therefrom.

Spaced abuttment members, comprising first and second pin members or the like, project from one side of each lateral member and frictionally engage opposite side portions of said vertical members. The spacing between said abuttment members is greater than the spacing between said opposite side portions of the vertical members so that upward swinging movement of said lateral members about one of said abuttment members releases the frictional engagement so that said lateral members may be vertically moved along said vertical members. Shoulder means, in the form of a flange or the like, is formed upon one of said abuttment members and overlappingly abutts a surface portion of said vertical member on the side surface thereof opposite from said lateral so that when said lateral member is supported in a selected position of frictional engagement relative separating movement between the lateral and vertical members is prevented. Still further, the spacing between said should means and the other abuttment member is greater than the distance between the opposite side portions of the vertical member so that upward swinging movement of said lateral member disengages said shoulder means and permits relative separating movement between said vertical and lateral members.

Enhanced and efficient burning of combustible material is achieved by arranging the materal upon said lateral members whereby to form a multiplicty of individually defined tiers disposed above one another. The tiers may then be vertically adjusted, in the manner hereafter described, for enabling optimal air circulation during combustion. Thereafter, as certain of the tiers are consumed by fire, new material may be inserted therein and spacing adjusted if necessary.

DETAILED DESCRIPTION OF THE PREFERRED EMBODIMENT

Figure 1:
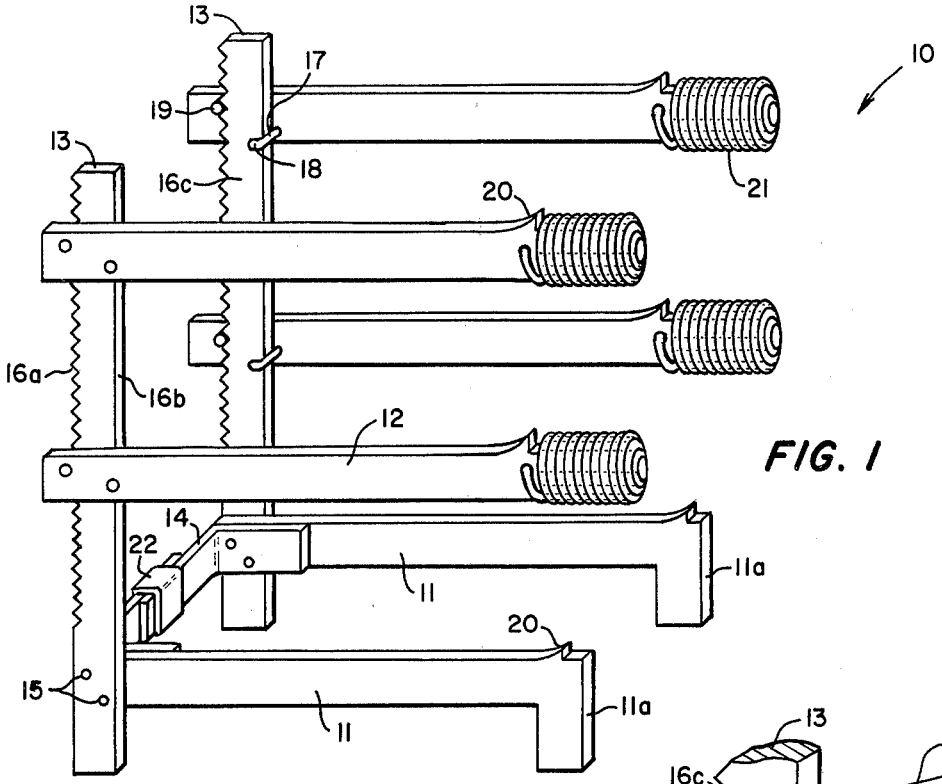
FIG. 1 is a perspective view of the preferred embodiment of the invention.

So that the invention is more easily understood, reference is now made to the accompanying drawings wherein like reference numerals refer to like parts throughout the several views. Of course, a person skilled in the art will fully comprehend that slight modifications can be made thereto without altering the suitability of the invention for its intended purpose. Therefore, it is intended that the following discussion not be construed in a limiting sense.

Coming now to FIG. 1, therein is shown a perspective view of a preferred embodiment of the invention, generally denoted by the reference number 10. Stated in fuller detail, device 10, constructed from any suitable metal, includes a base portion comprising at least two support members 11 disposed upon the floor of a fireplace enclosure. A cross-member 14 is interposed between support members 11 and rigidly secured thereto whereby to form a stable platform. As shown in FIG. 1, support members 11 are elevated above ground and have downwardly turned legs 11*a* at one end thereof disposed upon ground. Upwardly turned retention dogs 20 are formed upon the lateral edge of members 11 to restrain logs supported thereon. While the elevation of members 11 above ground is not critical to the operation of the invention, such is preferred so that said members 11 may further serve as a lower grate for supporting combustible materials.

Similarly, the depicted configuration and location of cross-member 14 is optional, cross-member 14 functioning simply to impart structrual rigidity to device 10. If desired, cross-member 14 may further comprise two substantially identical members rigidly urged against each other by any suitable clamping means 22 or the like whereby to permit variable lateral displacement between members 11.

Device 10 further includes at least two spaced vertical members 13 rigidly secured by bolts 15 or the like to said base portion and projecting upwardly therefrom. Each of the vertical members 13 are of substantially rectangular cross-section having opposite side portions thereon, a first side portion 16*a* and a second side portion 16*b*. As will be more fully discussed and appreciated later, said first lateral edge 16*a* is preferrably serrated along a major portion thereof.

Figure 2:
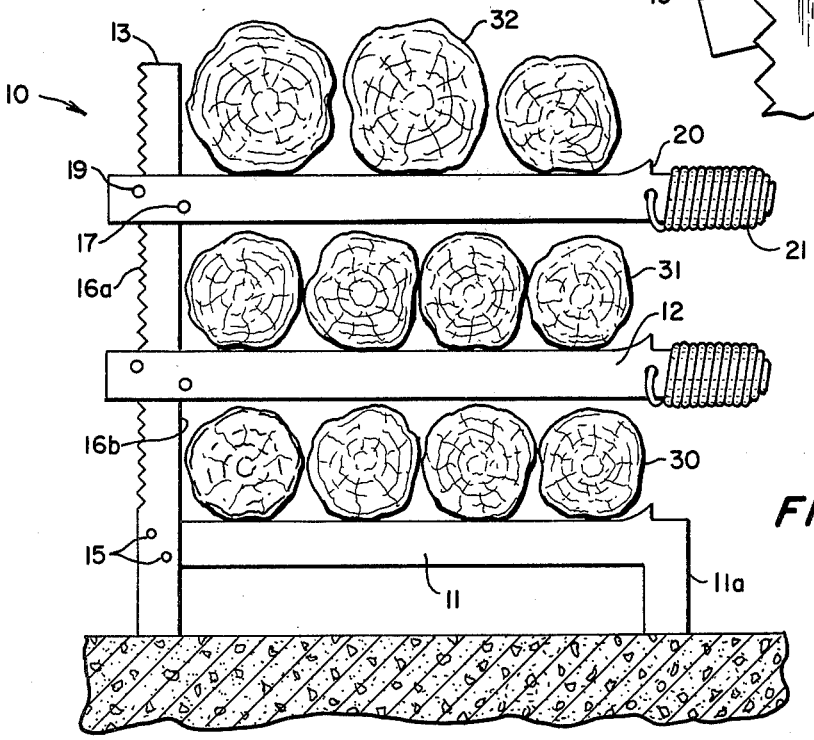
FIG. 2 is a side view of the device shown in FIG. 1.

Further included within device 10 are at least two log support or lateral members 12, each adjustably secured in a selected position of adjustment upon support members 13. In said selected position the longitudinal axes of adjacent pairs of lateral members 12 are aligned in a substantially horizontal plane above said base portion. An upwardly turned retention dog 20 is formed upon the forwardly extending end of each member 12 to prevent logs placed thereon, as shown in FIG. 2, from rolling off said member 12. Optionally, a heat dissipating handle member 21, such as coiled wire, wood, or the like, may be secured to said forwardly extending end to facilitate the manual articulation of member 12 in the vertical plane.

Figure 3:
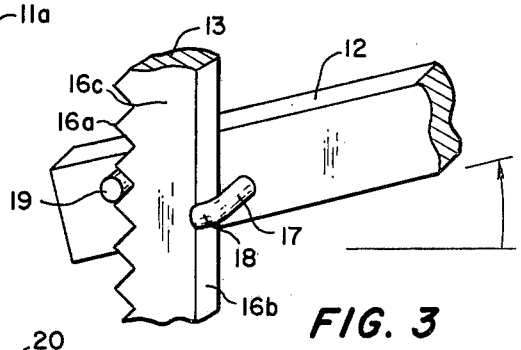
FIG. 3 is a cut-away perspective view of the device shown in FIGS. 1 and 2 more fully illustrating an embodiment of said abuttment members and shoulder means.

Lateral members 12 are held in adjustable securement upon vertical members 13 by spaced abuttment members which project from one side of members 13 towards side portions 16*a* and 16*b* of vertical members 13 for frictional engagement therewith. As shown in FIGS. 1 and 3, said abuttment members may be in the form of a first pin member 19 engaging the serrated edge of said first side portion 16*a* and a second pin member 17 engaging said second side portion 16*b* and spaced apart from pin member 19 a distance which is greater than the distance between opposite side portions 16*a* and 16*b* of vertical member 13. In this manner of forming said abuttment members upward swinging movement of lateral member 12 about one of said pin members releases the frictional engagement between said pin members and said opposite side portions so that lateral member 12 may be adjusted vertically along vertical member 13. By including serrations along the major portion of side portion 16*a*, pin member 19 is firmly retained in place thereon, thus mitigating against lateral member 12 slipping from a preferred position. If desired, side portion 16*b* may also be configured with serrations to engage pin member 17.

In order to preclude the inadvertent separation of lateral member 12 from vertical member 13, pin member 17 preferably includes shoulder means upon its distal end in the form of an integral flange 18 or the like, which engages in overlapping fashion lateral surface portion 16*c* of vertical member 13. As best shown in FIG. 3, the spacing between flange 18 and pin member 19 is greater than the distance between opposite side portions 16*a* and 16*b* so that as lateral member 12 is moved in an upward swinging movement about pin member 19, flange 18 is caused to move out of overlapping engagement with lateral surface portion 16*c* of vertical member 13 to thereby permit relative separating movement between members 12 and 13.

Referring now to FIG. 2, the operation of device 10 is as follows. A first tier 30 is formed by arranging pieces of combustible material, having lengths substantially greater than their cross-sectional diameter, parallel to and substantially in longitudinal contact with one another, upon support members 11. A second tier 31 of combustible material is then formed upon lateral members 12 above said tier 30, an interstitial void being provided therebetween to permit the entrainment of air during combustion. Optionally, a third tier 32 may be identically formed over tier 31. Kindling (not shown) is next disposed subjacent tier 30 and ignited, whereupon combustion sequentially proceeds upwards through the multiplicity of combustible material tiers. As certain of the tiers are consumed, device 10 readily permits the replenishment of combustible material and repositioning within the fire to effect efficient ignition and burning. If, for example, tier 31 is first consumed, the members 12 supporting said tier 31 may be upwardly swung to disengage flanges 18 and thence removed. Tier 32 may then be lowered to a position proximate tier 30, and a new tier of logs formed over tier 32 following the reattachment of the removed members 12 to the vertical members 13. In this manner the fire produced by the lowermost tiers is utilized to ignite the newly inserted material, thereby sustaining combustion.

I have noted that by providing a minimum mean free path within the range of about 0.5 to 1.5 inches between adjacent tiers, the spacing being proportionaly related to log-section diameter, an intense fire is formed which generates a significant amount of heat and further permits the consumption of materials hitherto generally considered to be unsuitable for burning within a fireplace. For example, tightly rolled newspapers, damp wood, and sap-contained logs, which usually smolder when burned upon conventional grates, are readily ignited and consumed. This is believed to be due in part to the novelty of the arrangement disclosed herein which provides vertical displacement between the tiers for the three-dimensional dispersement of combustible material, airflow, and ignition temperature.

Based upon the foregoing, it is to be appreciated that herein is disclosed a new and useful means for effecting the efficient burning of combustible materials maintained in a preferred geometric relationship. While a preferred embodiment has been disclosed, it is to be appreciated that various changes, modification, and rearrangements can be made without departing from the scope and essence of the invention as defined in the appended claims. Therefore, to the extent such changes, modifications, and rearrangements can be made, they are considered to be within the scope of my invention.

What is claimed is:

1. In an andiron for supporting combustible logs, said andiron having a base portion, at least one vertical member projecting upwardly from said base portion, at least one lateral member adjustably supported on one side of said vertical member, there being spaced abutment members projecting from one side of each lateral member towards and frictionally engaging opposite edge portions of one of said vertical members to hold said lateral member in a selected position of adjustment on said vertical member, the spacing between said abutment members being greater than the spacing between said opposite edge portions of said vertical member such that upward swinging movement of said lateral member about one of said abutment members releases said frictional engagement to permit vertical movement of said lateral member along said vertical member, the improvement wherein one of said abutment members engages said vertical member only on the edge portion thereof opposite that with which the other abutment member is in engagement, said other abutment member being formed with shoulder means in overlapping engagement with a surface portion of said vertical member on the side thereof opposite said lateral member when said lateral member is in said selected position to thereby prevent relative separating movement of said vertical and lateral members, said shoulder means being spaced from the other of said abutment members a distance greater than the spacing between said opposite edge portions of said vertical member such that said upward swinging movement of said lateral member about the longitudinal axis of the abutment member in engagement with only the edge portion of said vertical member permits movement of said shoulder means out of said overlapping engagement with said vertical member surface portion to thereby permit relative separating movement of said vertical and lateral members.

2. An andiron as set forth in claim 1 further comprising a second vertical member projecting upwardly from said base portion and spaced apart a preselected distance from said first vertical member, and a second lateral member adjustably supported upon one side of said second vertical member in said selected position of adjustment.

3. An andiron as set forth in claim 2 wherein said base portion comprises a pair of combustible log support members elevated above ground and each rigidly connected, respectively, to one of said vertical members.

4. An andiron as set forth in claim 2 further comprising means connected to each of said first and second vertical membes for adjustably varying said preselected distance.

5. An andiron as set forth in claim 1 further comprising a second vertical member projecting upwardly from said base portion and spaced apart a preselected distance from said first vertical member, said andiron having at least two lateral members adjustably supported upon one side of each of said vertical members.

6. An andiron as set forth in claim 5 wherein said base portion comprises a pair of combustible log support members elevated above ground and each rigidly connected, respectively, to one of said vertical members.

7. An andiron as set forth in claim 5 further comprising means connected to each of said first and second vertical members for adjustably varying said preselected distance.

8. An andiron as set forth in claims 1, 2, 3, 4, 5, 6 or 7 wherein at least one of said opposite edge portions of each of said vertical members is serrated along a major portion of the length thereof.

* * * * *